United States Patent [19]

Tatro

[11] Patent Number: 4,663,875

[45] Date of Patent: May 12, 1987

[54] RIFLE HANDGUARD ASSEMBLY HAVING OUTER SHELL WITH OUTER AND INNER LINERS

[75] Inventor: Henry J. Tatro, Westfield, Mass.

[73] Assignee: Colt Industries Inc., New York, N.Y.

[21] Appl. No.: 814,254

[22] Filed: Dec. 30, 1985

[51] Int. Cl.[4] ..... F41C 23/00; F41D 11/18

[52] U.S. Cl. ..... 42/71.01; 89/14.1; 165/134.1

[58] Field of Search ..... 42/71.01, 75.01; 89/14.1; 165/47, 55, 134.1

[56] References Cited

U.S. PATENT DOCUMENTS

| | | | |
|---|---|---|---|
| 2,126,792 | 8/1938 | MacGregor | 89/14.1 |
| 2,965,994 | 12/1960 | Sullivan | 42/71.01 |
| 3,075,314 | 1/1963 | Bakker | 42/71.01 |
| 3,090,150 | 5/1963 | Stoner | 42/71.01 |
| 4,413,668 | 11/1983 | Allard | 165/47 X |
| 4,536,982 | 8/1985 | Bredburg et al. | 42/71.01 |

*Primary Examiner*—Deborah L. Kyle
*Assistant Examiner*—Ted L. Parr
*Attorney, Agent, or Firm*—Richard A. Dornon

[57] ABSTRACT

A generally round handguard assembly (10) for a rifle barrel (18) has substantially identical bottom and top mating sections (26, 28). The handguard assembly has a shell with an upper and lower row of vent holes (36) formed by two shell sections (31), an outer liner, formed by two outer liner sections (35), with upper and lower rows of vent holes (58) and an inner liner, formed by two inner liner sections (33), with upper and lower pairs of laterally opposed rows of vent holes. An outer annular volume (94), an intermediate annular volume (92) and an inner annular volume (90), which are in fluid communication, are defined within the shell by its inner periphery and the liners. Air flow in the inner volume cools the barrel and gas tube (22) and air flow in the outer and intermediate volume maintains the shell at a reasonable temperature during repeated firings.

6 Claims, 7 Drawing Figures

RIFLE HANDGUARD ASSEMBLY HAVING OUTER SHELL WITH OUTER AND INNER LINERS

TECHNICAL FIELD

This invention relates to handguard assemblies for rifles.

BACKGROUND ART

U.S. Pat. No. 4,536,982 discloses a rifle handguard assembly having identical mating sections which define a cylindrical outer shell and a cylindrical liner surrounding the barrel. In the handguard assembly of this patent, the liner is designed to prevent heat transfer to the rear of the shell so that a user may comfortably grip the handguard assembly after repeated firing. While the handguard assembly of this patent exhibits eminently satisfactory performance with barrels of reasonable length, utilization of this handguard assembly with short barrels, such as found on carbines, may result in the rear of the shell being heated to a high temperature which produces uncomfortable sensations in a user's hand.

DISCLOSURE OF INVENTION

In accordance with the invention, there is provided a handguard asembly well-suited to use with gas operated automatic weapons, such as carbines, where substantial heat is generated by a relatively short barrel and gas tube assembly.

A handguard assembly of the invention, while utilizing a shell similar in design to that of the aforementioned patent with all of the attendant advantages, employs outer and inner liners, each of a generally cylindrical configuration. The inner liner has two upper rows of laterally opposed vent holes and two lower rows of laterally opposed vent holes. The outer liner has upper and lower centrally disposed rows of vent holes which register with the vent holes in the shell. First, second, and third annular volumes are respectively defined between the barrel and the inner liner, the inner and outer liner, and the outer liner and the shell. Cooling air from the vent holes in the shell beneath the barrel proceeds to the second annular volume through the lower vent holes in the shell and the lower vent holes in the outer liner. The air flows thence through the lower row of laterally opposed vent holes into the first annular volume where heat from the barrel and gas tube is transferred thereto. In like manner, heated air exits the first annular volume through the upper row of laterally opposed vent holes and proceeds the exterior of the handguard assembly through the second annular volume and the upper row of vent holes in the outer liner and the shell. Cooling air also circulates from the lower vent holes in the shell to the upper vent holes in the shell via the third annular volume.

The liner configuration of the invention provides adequate cooling air flow to maintain the shell temperature at a comfortable level even after successive firings while furnishing adequate cooling of the barrel and gas tube.

Accordingly, it is a primary object of the invention to provide a handguard assembly for an automatic rifle which is particularly well-suited to rifles with relatively short barrels.

This and other objects and advantages of the invention will become more readily apparent from the following detailed description taken in conjunction with the accompanying drawings.

BEST MODE OF CARRYING OUT THE INVENTION

Figure 2:
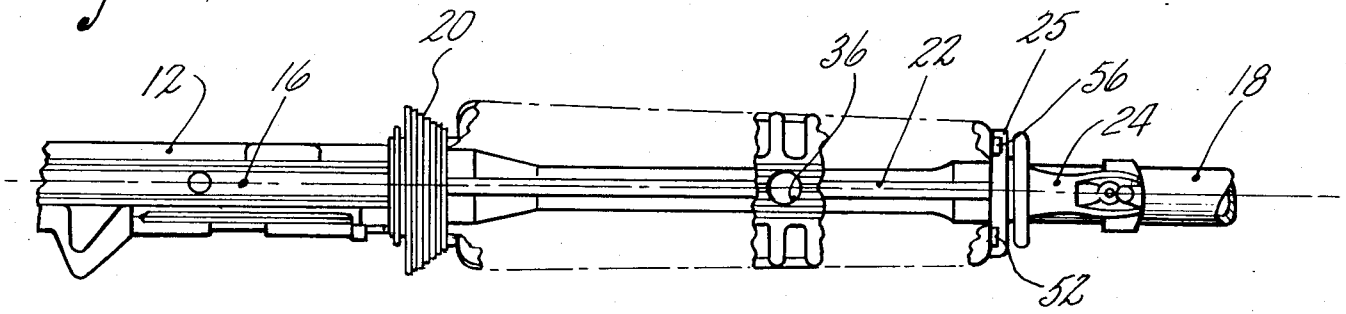
FIG. 2 is a fragmentary top plan view of the rifle of FIG. 1, taken substantially along the line 2—2 of FIG. 1.
Figure 1:
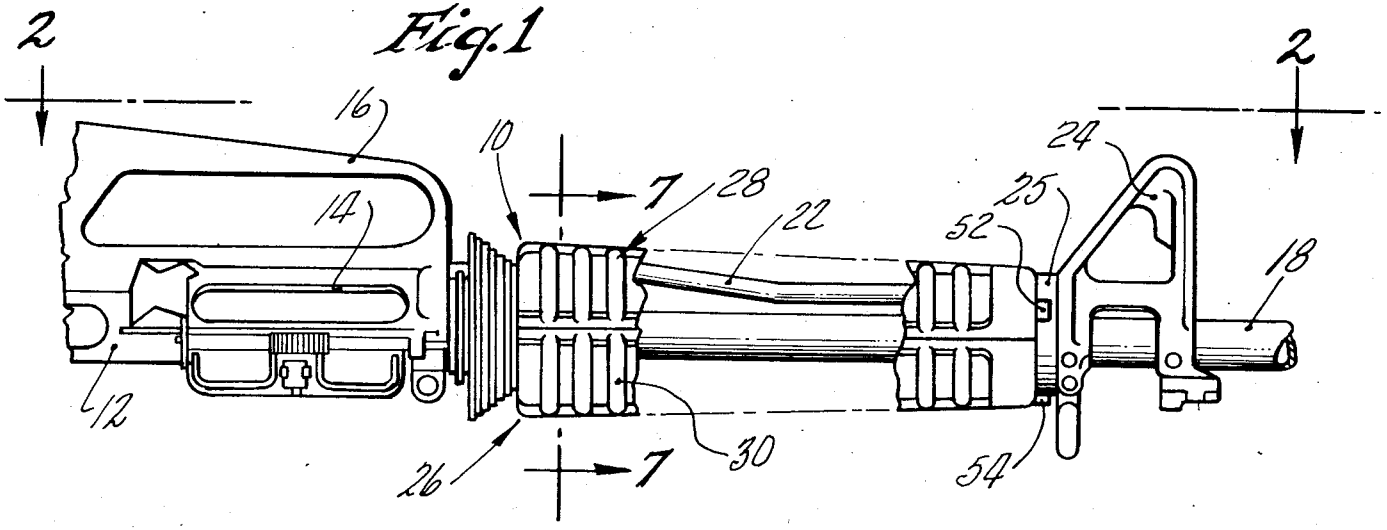
FIG. 1 is a fragmentary side elevational view of a rifle incorporating a handguard assembly of the invention.
Figure 3:
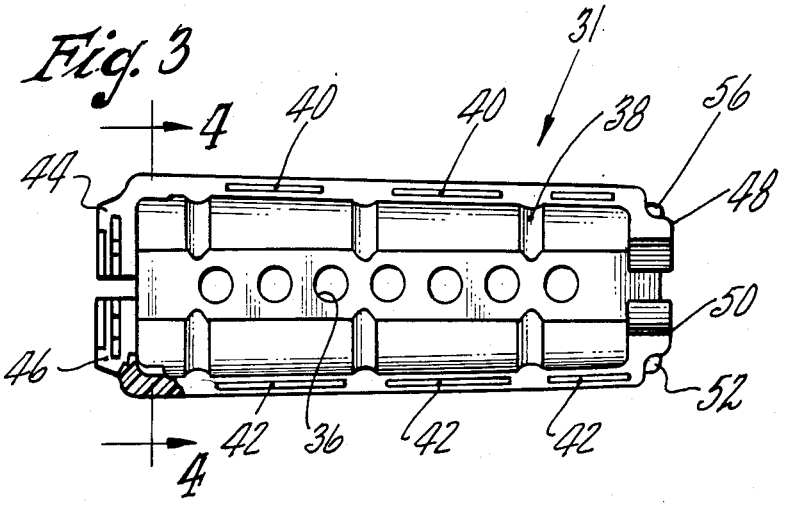
FIG. 3 is a top plan view of a shell section, per se.
Figure 4:
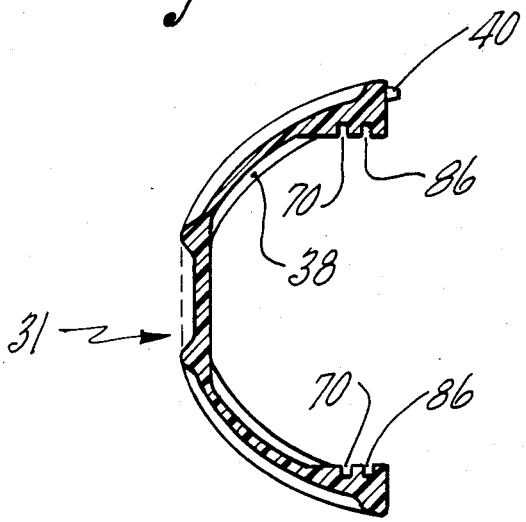
FIG. 4 is a sectional view of the shell section of FIG. 3, taken substantially along the line 4—4 of FIG. 3.

With reference to FIGS. 1 and 2 there is shown a conventional M16 type carbine incorporating a handguard assembly of the invention, generally shown at 10. The rifle incorporates the usual upper receiver section 12 having an ejection port 14 and a carrying handle 16. Extending from the upper receiver section 12 is a barrel 18 and a slip ring 20 for securing the rear end of the handguard assembly. The slip ring 20 can be rearwardly displaced against a spring load to release the handguard assembly and permit removal thereof. Also communicating with the upper receiver section 12 is a gas tube 22 which supplies gas to operate the firing mechanism. A sight and gas tube assembly 24 is mounted upon the relatively short barrel 18 adjacent the front end of the handguard assembly 10 in communication with gas tube 22. Interposed between the sight and gas tube assembly 24 and the front end of the handguard assembly is a triangular handguard cap 25 which functions to clamp the sections of the handguard together and furnish a forward abutment surface.

With continued reference to FIGS. 1 and 2, it will be noted that the handguard assembly 10 is comprised of a lower section and an upper section, generally designated 26 and 28, respectively. The sections 26 and 28 are in all respects identical and define a handguard assembly of generally circular cross section with a progressively decreasing diameter in the forward direction. Ribs 30 are provided on the exterior portions of the sections to enhance structural integrity and provide for a firm grip.

Referring to FIGS. 3–6, it may be seen that section 26 of the handguard assembly 10, which is identical to section 28, is constituted by an outer, generally semicylindrical shell section generally shown at 31, and inner and outer handguard liner sections, generally shown at 33 and 35, respectively. The shell section is preferably made of a plastic thermosetting, plastic compound FM-8130E (or equivalent) available from Fiberite Corp and the liner sections 33 and 35 are preferably constituted by aluminum alloy stampings. The shell section 31 is essentially similar in design to that shown in U.S. Pat. No. 4,536,982.

The shell section 31 has a plurality of vent holes 36 arranged in a longitudinal row in the center thereof. The vent holes 36 extend substantially from the front to rear of the shell section 31 and provide cooling for the barrel 18 and the liners. The interior of the shell section 31 is formed with a plurality of stiffening ribs 38. The left (FIG. 5) or top (FIG. 3) edge of the shell section 31 has a plurality of tongues 40 projecting therefrom while the lower or left edge of the shell section has a plurality of grooves 42 formed therein. The tongues of each shell section are adapted to fit into the grooves of the shell section of the confronting section when the handguard assembly sections are assembled as shown in FIGS. 1 and 2.

The rear end of the shell section 31 embodies two arcuate extensions 44 and 46 which, with the corresponding arcuate extensions of the confronting section 28, are received within the slip ring for clamping the sections 26 and 28 together. The front end of the shell section 31 incorporates two arcuate extensions 48 and 50 adapted to be inserted in the handguard cap 25. Formed on the front end of the handguard assembly section 26 between the outer periphery thereof and the extensions 48 and 50 are three equally spaced lugs 52, 54 (FIGS. 1 and 2), and 56 upon which the triangular cap may be seated, as more fully described in U.S. Pat. No. 4,536,982.

Figure 5:
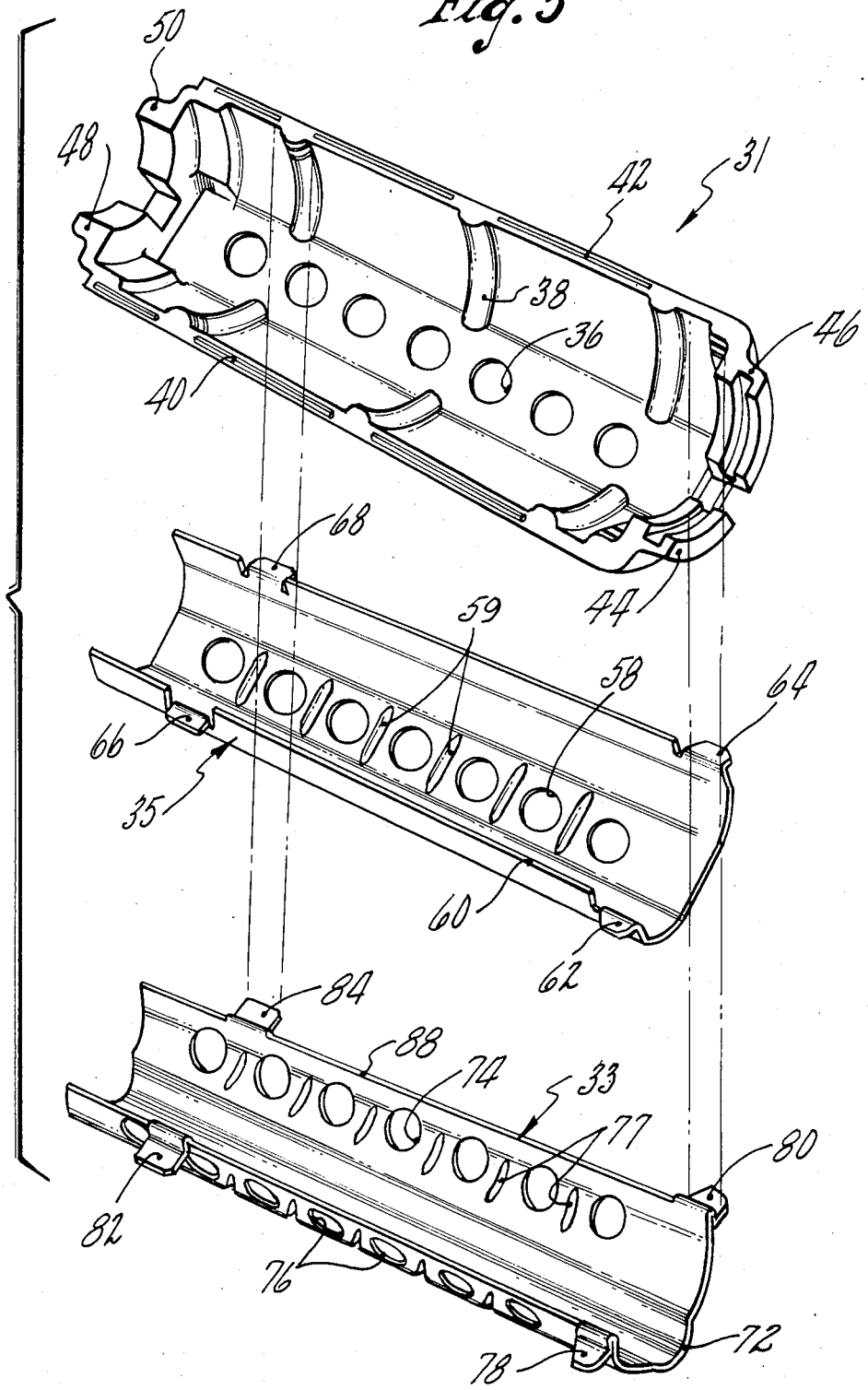
FIG. 5 is an exploded view of a section of the handguard assembly of FIG. 1.
Figure 7:
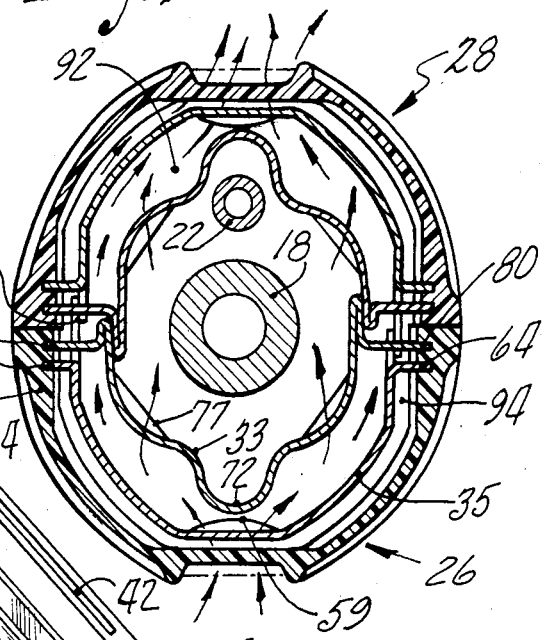
FIG. 7 is a sectional view of the rifle of FIG. 1, taken along the line 7—7 of FIG. 1.

As best shown in FIGS. 5 and 7, the outer liner section 35 is generally of a semicylindrical configuration and has a plurality of vent holes 58 which lie in a centrally disposed longitudinal row. Ribs 59 are provided between holes 58 to prevent deformation during assembly. The vent holes 58 register with the vent holes 36 in the shell section 31. The liner section 35 is provided with a flange 60 which extends upwardly from the left side of the liner section 35, as viewed in FIG. 5, such that in the handguard assembly, the inboard surface of the flange 60 engages the outboard surface of the confronting liner section so as to form a laterally sealed annular volume between the liner sections. In order to mount the liner section 35 in the shell section 31, four tabs 62, 64, 66, and 68 are provided on the liner section 35 and extend laterally from the sides thereof. The tabs are received with lateral slots (such as shown at 70 in FIGS. 4 and 7) in the ribs of the shell section adjacent the sides of the liner section 35. When properly mounted in the shell section 31, the liner section 35 is spaced a small distance from the inner periphery thereof, thereby defining an annular volume therebetween.

Figure 6:
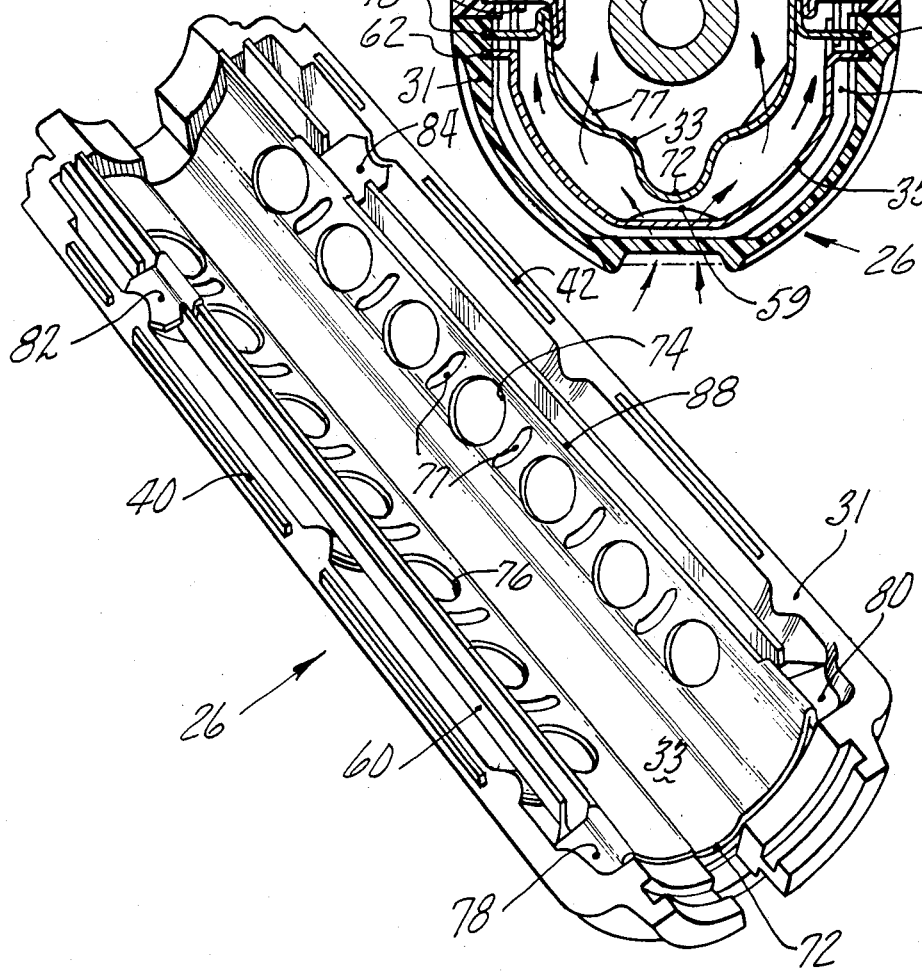
FIG. 6 is a perspective view of one of the sections of the handguard assembly.

With reference to FIGS. 5–7, the inner liner section 33 may be seen as being of a generally semicylindrical configuration and having a longitudinal ridge 72 running along the center thereof. Inner liner section 33 is also furnished with two laterally opposed longitudinal rows of vent holes 74 and 76 as best shown in FIG. 6. Ribs 77 are provided between the vent holes to prevent deformation during assembly. It will be noted that the vent holes 74 and 76 are laterally offset and radially spaced from the vent holes 58 such that there is no alignment therebetween. As is the case with the outer liner section 35, the inner liner section 33 incorporates tabs 78, 80, 82, and 84 for mounting the inner liner section 33 in the shell section 31. The tabs of the inner liner are received within lateral slots (such as shown at 86 in FIGS. 4 and 7) which are respectively located closely adjacent the slots 70 but closer to the edges of the shell section. Hence, it will be noted that four selected ribs 40 are each provided with two overlying slots 70 and 86. In order to permit the tabs of the inner liner to extend laterally into their respective slots, the upper sides of the outer liner section 35 are cutaway, adjacent each tab 62, 64, 66, and 68 thereof to allow for passage of the respective tabs 78, 80, 82, and 84 of the outer liner section 35.

The inner liner section 33 is spaced from the outer liner section 35, as shown in FIG. 7, and embodies a flange 88 projecting from the right side thereof (see FIG. 6) which engages the inboard surface of the confronting liner section so as to form a laterally sealed annular volume between the inner liner section in the handguard assembly which envelopes the barrel 18 and gas tube 22.

It will thus be seen from FIG. 7 that the handguard assembly of FIGS. 1, 2, and 7 includes an outer shell (defined by two shell sections), an outer liner (defined by two sections, and an inner liner (defined by two sections). With reference to FIG. 7, it will further be observed that the shell and liners of the handguard assembly define a first or inner annular volume 90, a second or intermediate annular volume 92, and third or outer annular volume 94, all of which are generally coaxial. It will further be appreciated that in the present handguard assembly, the shell and the outer liner each have upper and lower rows of vent holes and that the inner liner has a lower pair of lateraly opposed rows of vent holes and an upper pair of laterally opposed rows of vent holes.

Air flow through the handguard assembly 10 is depicted in FIG. 7 by the small arrows. Cooling air enters the handguard assembly through the lower vent holes 36 in the shell and proceeds to the outer annular volume 94. Most of the air traverses the volume 94 and enters the lower vent holes in the outer liner while some of the air flows upwardly through the outer volume 94 directly to the upper vent holes in the shell. Air from the lower vent holes 58 in the liner enters the intermediate volume 92 and proceeds thence to the laterally opposed lower vent holes 74 and 76 in the inner liner. However, some air in the lower portion of the intermediate volume 92 flows upwardly to exit at the upper vent holes in the outer liner. Air entering the inner volume from the vent holes 74 and 76 flows upwardly past barrel 18 to thereby cool the barrel and the adjacent gas tube 22. Heated air exits the inner volume 90 via the upper lateally opposed row of vent holes in the inner liner from where it rejoins the upward air flow in the upper portion of the intermediate volume 92 and proceeds to the upper vent holes in the outer liner. Flow from the latter mentioned vent holes joins that in the upper portion of the outer volume and finds egress through the upper vent holes in the shell.

It will thus be appreciated that, in a handguard assembly of the invention heat from the barrel and gas tube can be effectively dissipated without causing undue heating of the shell and that the flow in the outer and intermediate annular volumes will function to maintain the shell at an acceptable temperature after repeated firings.

Obviously, many modifications and variations are possible in light of the above teachings without departing from the scope or spirit of the invention as defined in the appended claims.

What is claimed is:

1. A handguard assembly for a rifle barrel comprising:

a generally cylindrical shell;

a generally cylindrical outer liner mounted in the shell in spaced relationship thereto such that an outer annular volume is defined between the inner periphery of the shell and the outer liner;

a generally cylindrical inner liner mounted in the shell in spaced relationship to the outer liner such that an intermediate annular volume is defined between the inner liner and the outer liner and an inner volume is defined by the inner liner;

first means to permit cooling air to flow from outside of the shell to the outer annular volume and heated air to flow from the outer annular volume to outside of the shell;

second means to permit air to flow from the outer annular volume to the intermediate annular volume and from the intermediate annular volume to the outer annular volume; and third means to permit air to flow from the intermediate annular volume to the inner volume and from the inner volume to the intermediate annular volume.

2. A handguard assembly, as defined in claim 1, wherein the first means comprises:

a lower row of vent holes in the shell and an upper row of vent holes in the shell.

3. A handguard assembly, as defined in claim 2, wherein the second means comprises:

a lower row of vent holes in the outer liner in registration with the lower row of vent holes in the shell and an upper row of vent holes in the outer liner in registration with the upper row of vent holes in the shell.

4. A handguard assembly, as defined in claim 3, wherein the third means comprises:

a lower pair of laterally opposed rows of vent holes in the inner liner and an upper pair of laterally opposed rows of vent holes in the inner liner.

5. A handguard assembly, as defined in claim 1, wherein the cylindrical shell comprises:

two substantially identical shell sections.

6. A handguard assembly, as defined in claim 5, wherein the outer liner comprises:

two substantially identical outer line sections; and wherein the inner liner comprises:

two substantially identical liner sections.

* * * * *